United States Patent [19]

Cairns et al.

[11] 4,191,943

[45] Mar. 4, 1980

[54] FILLER-IN-PLASTIC LIGHT-SCATTERING COVER

[75] Inventors: Bruce R. Cairns, Los Altos; David B. Crockett, San Jose, both of Calif.

[73] Assignee: Fairchild Camera and Instrument Corporation, Mountain View, Calif.

[21] Appl. No.: 887,902

[22] Filed: Mar. 17, 1978

Related U.S. Application Data

[63] Continuation of Ser. No. 733,554, Oct. 18, 1976, abandoned.

[51] Int. Cl.[2] ..... G08B 5/36

[52] U.S. Cl. ..... 340/378.2; 340/383; 340/366 R

[58] Field of Search ..... 340/378 R, 336, 366 R, 340/324 R, 383; 313/498, 499, 116; 40/106.52; 356/215, 225

[56] References Cited

U.S. PATENT DOCUMENTS

| | | | |
|---|---|---|---|
| 2,706,262 | 4/1955 | Barnes | 313/116 |
| 3,786,499 | 1/1974 | Jankowski | 340/378 R |
| 3,911,430 | 10/1975 | Jankowski | 340/378 R |

*Primary Examiner*—Harold I. Pitts

*Attorney, Agent, or Firm*—Alan H. MacPherson; Ronald J. Meetin; Robert C. Colwell

[57] ABSTRACT

Small light-conductive particles are scattered randomly in light-conductive plastic. Improved light-scattering characteristics for solid-state display covers is provided.

22 Claims, 4 Drawing Figures

FILLER-IN-PLASTIC LIGHT-SCATTERING COVER

CROSS REFERENCE TO RELATED APPLICATION

This is a continuation of patent application Ser. No. 733,554, filed Oct. 18, 1976, now abandoned.

BACKGROUND OF THE INVENTION

1. Field of the Invention

This invention is in the field of packages for solid-state displays. More specifically, this invention relates to a filler-in-plastic cover that provides protection and improved light-scattering characteristics.

2. Description of the Prior Art

Packages of the same general type as the one of this invention are known, and have been described in U.S. Pat. No. 3,911,430 and U.S. Pat. No. 3,786,499, both assigned to the same assignee as this invention. Such packages generally employ a supporting substrate on which are mounted a plurality of light-emitting diodes. Located over the diodes are a plurality of light pipes, one pipe for each diode, that function to transmit light from the diodes to a translucent protective cover.

Previously, in order to reduce regions of concentrated light intensity, sometimes referred to as "hot spots," some kinds of lens mechanism has been provided to disburse light from the light-emitting diodes. For example, a surface of the protective cover, such as the interior surface facing the light-emitting diodes, has been formed so that the surface comprises a plurality of concentric circles, creating what is often referred to as a fly's eye lens. As known in the art, fly's eye lenses function to disperse impinging light and reduce unwanted regions of high light concentration. FIG. 1 shows a device with a plurality of fly's eye lenses, such as lens 5.

Unfortunately, it is difficult to mass produce transparent protective covers having one surface thereof comprising fly's eye lenses. For example, in prior-art applications, use has been made of a die stamp attached to a support to form the fly's eye lenses. With high-volume use, the stamp often comes loose from its support. To prevent production problems that arise when the stamp and support separate from each other, an alternative approach, comprising use of a mold of a very hard material, such as tool steel, has been used for the die. Making a mold of tool steel is a slow and costly process because hundreds to thousands of small circles must be created in one surface of the mold. Because such a mold is slow and costly to produce, this approach lacks the flexibility desirable in semiconductor technology where many different sizes and shapes of covers are needed. Most users are reluctant to pay the high cost of numerous tool steel molds. It is also difficult using tool steel to obtain the correct fly's eye lens shape for optimum light scattering.

After a cover with fly's eye lenses is made, if a misalignment occurs between the fly's eye pattern in the cover and a segment of the alpha-numeric display, such as a numerical character, illumination of the character can be uneven. Moreover, during the time when a character is initially displayed, the fly's eye pattern sometimes can be seen due to a different light output in each point on the fly's eye surface. Furthermore, the fly's eye lens system does not eliminate enough of the "hot spot" in the center of a character, compared to the ends of a character. In addition, the fly's eye lens system tends to scatter too much of the light away from the direct viewing axis of the display, which is the most important direction in which to have high illumination.

Some prior-art approaches have made use of a combination of a fly's eye lens system and use of small light-scattering particles in the protective cover, with the small particles comprising one to four percent by weight of the protective cover. The small particles help reduce the "hot spot" problem of the fly's eye lens system but increase the scattering of light away from the direct viewing axis of the display. This combination of fly's eye lenses and light-scattering particles often reduces the intensity of the light by a factor of two. When the light-scattering particles in a protective cover are above four percent by weight, the combined effect with a fly's eye lens system results in a light intensity that is too low to be acceptable for many applications.

Therefore, a new approach is needed to scatter light through a translucent protective cover without the disadvantages of the fly's eye lens system. The approach should be easy and inexpensive to produce on a high-volume basis, it should not require a mold that is slow and costly to manufacture, it should provide great flexibility in allowing many different sizes and shapes of covers to be made, it should eliminate differences in illumination between the center and edges of a character, and it should scatter more light through the cover on the direct viewing axis than that of the fly's eye lens approach.

SUMMARY OF THE INVENTION

The filler-in-plastic protective cover of the invention for use with alpha-numeric display packages overcomes some of the problems and disadvantages of prior-art protective covers using a fly's eye lens system by enabling light incident thereto to be scattered without the need of fly's eye lenses and their problems. Briefly, the protective cover of the invention for use in alpha-numeric display packages comprises a layer of transparent or translucent plastic material into which are embedded a multiplicity of small transparent or translucent particles, the particles being scattered throughout the plastic material on a random basis, with the particles having an index of refraction that is different from that of the plastic layer. The small particles comprise approximately six to twenty-five percent by weight of the contents of the protective cover, and suitably consist of glass, crystal, or a plastic material of a different kind from that used in the plastic layer.

DESCRIPTION OF THE PREFERRED EMBODIMENT

Figure 1:
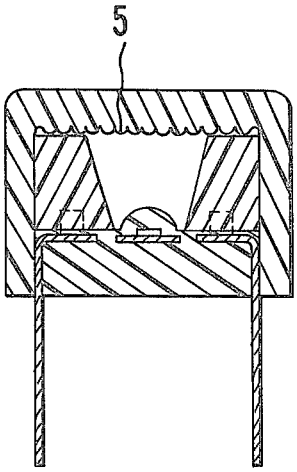
FIG. 1 PRIOR ART
FIG. 1 is a simplified, cross-sectional view of a prior-art, alpha-numeric display package having a protective cover, with one surface of the cover comprising a fly's eye lens system to scatter impinging light.
Figure 2:
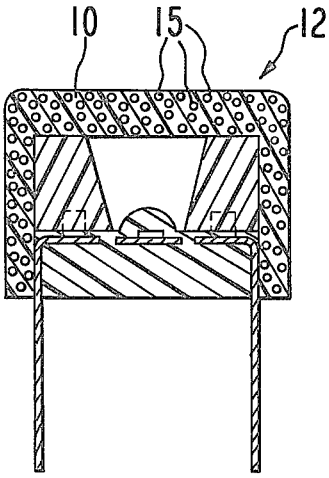
FIG. 2 is a simplified cross-sectional view of the improved protective cover of the invention with a multiplicity of tiny particles embedded within and located randomly in the protective cover to scatter impinging light.

Referring to FIG. 2, the protective cover of the invention for use with alpha-numeric display packages comprises a protective layer 10 of translucent or transparent material, such as plastic. Suitably, layer 10 comprises a transparent or translucent thermoplastic, such as Lexan, manufactured by General Electric Corporation, or Merlon, manufactured by Mobay Chemical Corporation, or the equivalent, including other suitable thermoplastic material. The protective layer 10 functions to transmit impinging light, and to protect semiconductor dice located inside the package from the environment. In its non-hardened state, the layer material 10 can be mixed with small particles of a filler material and then hardened in any shape desired for placement over the exposed portion of the display package.

Embedded within layer 10 is a filler material comprising a multiplicity of small solid particles, such as particle 15, of a translucent or transparent material, randomly scattered throughout layer 10. Suitably, the filler material of small, solid particles comprises glass, such as Corning 1720 aluminum silicate 325 mesh powder glass, or the equivalent. A mesh of 325 means that at least ninety percent of the particles are less than forty-four microns in diameter. With layer 10 comprising a thermoplastic, such as Lexan (mentioned above), which has a density of about 1.20 grams per cubic centimeter, and with particles 15 comprising a glass, such as Corning 1720 glass, which has a density of about 2.52 grams per cubic centimeter, so that the ratio of the densities of the two materials is about 1 to 2, the contents of layer 10 preferably comprises six to twenty-five percent by weight of small particles 15, and the remainder is plastic.

The small, solid particles 15 have an index of refraction that is different from that of the plastic material in layer 10. For example, the index of refraction of Lexan thermoplastic is about 1.586 while that of Corning 1720 glass is about 1.530, so that the difference between the two indices of refraction is 0.056. As known in the art, when light leaves one medium and enters another medium having an index of refraction that is different from that of the first medium, the light bends, with the direction and degree of bend being a function of the relationship between the two indices of refraction as well as the angle at which the light approaches the surface of the second medium, and the location and shape of the small solid particles. Light travelling through the protective cover 12 first enters the plastic layer 10, then enters a solid particle, where it bends, then reenters the plastic layer where it bends again, then enters another particle where it bends, and so on, bending repeatedly as it travels from particle to particle through the plastic layer 10, so that substantial scattering of light occurs.

For many applications, the plastic cover is approximately 0.027-inch thick, so that an optimum effect is reached when the light-scattering particles are ten to eleven percent by weight of the plastic. It has been found that for a given ratio of density of particles to density of plastic, when the quantity of particles in the plastic cover decreases, and in particular approaches less than five percent by weight, the light intensity increases but the "hot spot" problem increases. On the other hand, when the quantity of the particles in the plastic cover increases and, in particular, approaches twenty-five percent by weight, the "hot spot" problem is eliminated, but the light intensity decreases. However, viewing from angles off the direct viewing axis is enhanced.

Other suitable solid particles for use as scattering material in the translucent plastic layer comprise crystal or even a plastic material whose index of refraction is different from that of the plastic layer 10. However, as the thickness of cover 12 increases, the amount of filler material needed for sufficient scattering decreases, whereas when the thickness of cover 12 decreases, the amount of filler material needed for sufficient scattering increases. For example, a double thickness of plastic layer 10 means that only one-half of the quantity of solid particles need be embedded in layer 10, compared to that of a single thickness layer 10. On the other hand, a one-half thickness of plastic layer 10 means that twice as many particles should be embedded in layer 10, compared to that of a single thickness layer 10. Some of the factors that determine the light-scattering characteristics of plastic layer 10 embedded therein with a filler material of small solid particles include the following: the ratio of the indices of refraction between the two materials; the size, shape, location, and quantity of the solid particles embedded in the plastic layer; and the thickness of the plastic layer 10.

It has been found that protective covers of the invention comprising a transparent or translucent plastic layer having embedded therein solid particles of a different index of refraction from that of the layer provide improved uniformity in light-scattering characteristics compared to prior-art approaches. In addition, such covers provide an intensity of light that is about twice that of a similarly sized prior-art protective cover using a fly's eye lens system without any increase in power consumption. Stated another way, for a given power consumption, the cover of the invention allows light to be transmitted therethrough with about twice the intensity as that of prior-art covers with the fly's eye lens system. The prior-art fly's eye lens system scatters too much light away from the direct viewing axis, so that an undesirable loss of light occurs in this most important direction for viewing the display. Moreover, the combination of light-scattering filler with a fly's eye lens system, which reduces the "hot spot" problem, also scatters too much light away from the direct viewing axis.

By comparison, the improved protective cover with embedded particles of the invention allows substantially more light to be transmitted through the cover in the desired viewing direction. Therefore, use of solid particles embedded in the plastic for the protective cover enables an underlying character display to be easier to read, or, in the alternative, allows a character display to be operated at about fifty percent less current than that needed for a protective cover with a fly's eye lens system, or a combination of fly's eye lens system and light-scattering filler. Consequently, power consumption for a given light intensity is substantially decreased with the structure of the invention.

Figure 3:
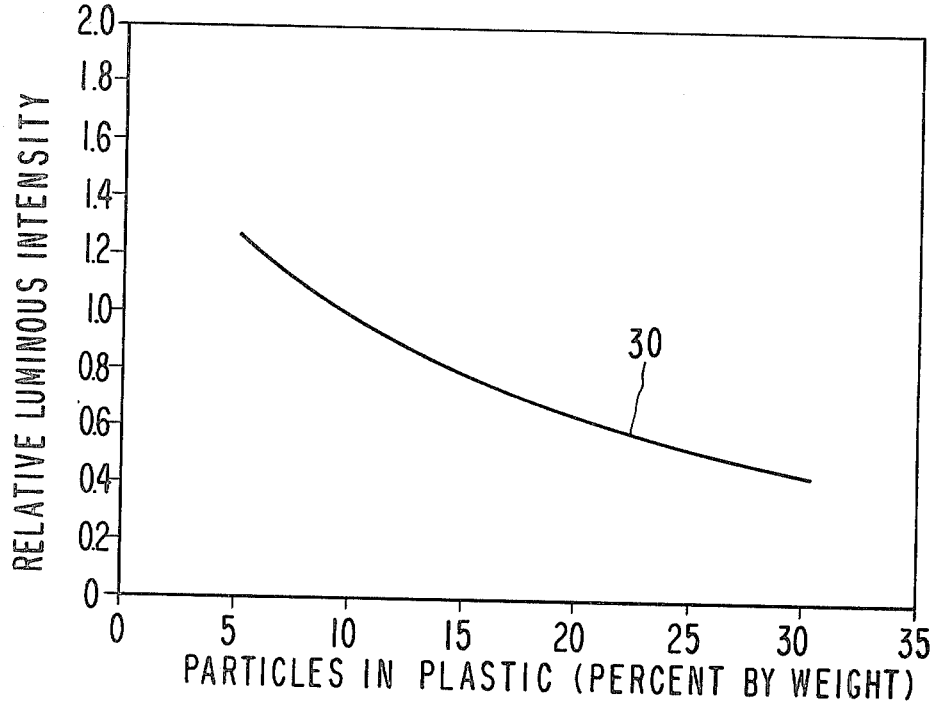
FIG. 3 is a graph indicating the variation in relative luminous intensity with change in percent by weight of particles in plastic.

Referring to FIG. 3, curve 30, which is a plot of luminous intensity as a function of particles in plastic, indicates that increasing the percent by weight of light-scattering particles in the plastic cover causes a decrease in the luminous intensity of light through the cover. Luminous intensity is referred to on the graph as "relative" because the detection of the luminous intensity at different quantities of particles was not an absolute reading, but does include the intensity of light when seen from the direct-viewing axis of the cover. Note that when the quantity of particles in plastic reaches ten percent by weight, the relative luminous intensity of light through the cover is about 1.0.

Figure 4:
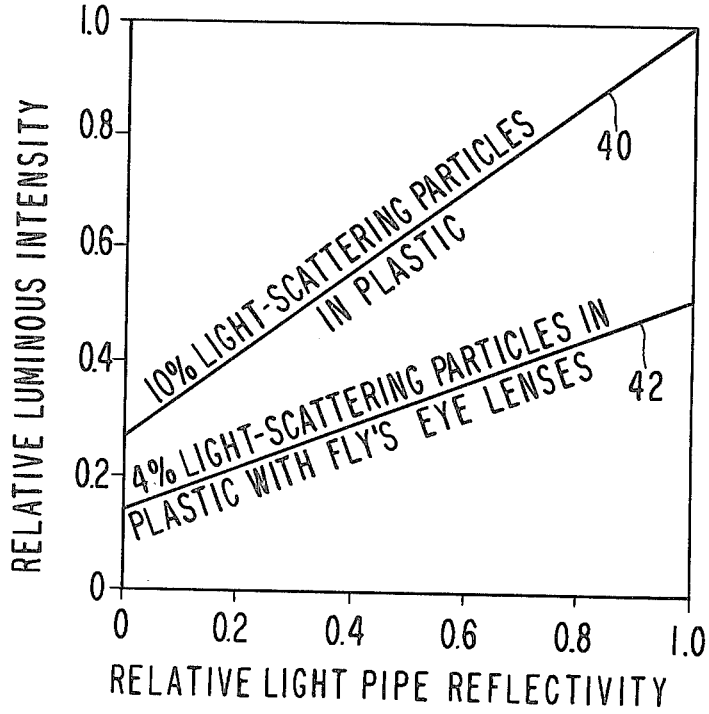
FIG. 4 is a graph comparing the relative luminous intensity of the cover of the invention having ten percent particles in plastic with a prior-art cover using a fly's eye lenses and four percent particles in plastic.

Referring to FIG. 4, the graph contains plots of luminous intensity as a function of light pipe reflectivity. The term "relative" is again used because the detection of reflectivity and luminous intensity are from that direct viewing axis, rather than being absolute. Curve 40 indicates that a plastic cover comprising ten percent by weight of light-scattering particles, such as Lexan thermoplastic with Corning 1720 glass particles embedded therein, provides superior relative luminous intensity characteristics when compared to that of a plastic cover containing four percent by weight of light-scattering particles plus one side of the cover having a plurality of fly's eye lenses, as indicated by curve 42.

A description of the structure of the light-emitting diodes, supporting substrate, light pipes, and lead frames has been given in patents referred to above, and that description is incorporated herein by reference.

What is claimed is:

1. A cover with light-scattering characteristics for use with packages for displaying alpha-numeric characters, the cover comprising a layer of plastic having a multiplicity of small, solid light-conductive particles randomly located therein and scattered therethrough, wherein said particles have an index of refraction different from the index of refraction of the plastic layer and wherein said particles comprise six to twenty-five percent by weight of the cover.

2. The cover of claim 1 wherein the plastic layer is transparent.

3. The cover of claim 1 wherein the plastic layer is translucent.

4. The cover of claim 1 wherein the small particles comprise glass.

5. The cover of claim 1 wherein the small particles comprise crystal.

6. The cover of claim 1 wherein the small particles comprise plastic.

7. The cover of claim 1 wherein the small particles comprise a transparent material.

8. The cover of claim 1 wherein the small particles comprise a translucent material.

9. A package for selectively displaying one of a plurality of alpha-numeric characters using a plurality of light-emitting diodes, each diode having a light-emitting surface providing a point of light corresponding to a segment of said characters when electrically activated, comprising:

a plurality of light-emitting diodes in the general shape of the necessary segments of all the alpha-numeric characters to be displayed, arranged laterally on a supporting substrate;

a plurality of light pipes, one above each diode for transmitting light therethrough; and a protective cover overlying said diodes, said supporting substrate, and said light pipes, said cover comprising a plastic layer with a multiplicity of small, solid, light-conductive particles scattered randomly therein, the particles having an index of refraction that is defferent from that of the plastic layer and comprising from six to twenty-five percent by weight of said protective cover.

10. In a package for selectively displaying one of a plurality of alpha-numeric characters having a plurality of light-emitting diodes, each diode having a light-emitting surface providing a point source of light corresponding to a segment of said characters when electrically activated, and a protective cover overlying said diodes and the support for said diodes, the improvement comprising a plurality of small, solid, light-conductive particles scattered randomly within the protective cover, the particles having an index of refraction that is different from that of the protective cover and comprising six to twenty-five percent by weight of the cover.

11. The cover of claim 4 wherein the glass is Corning 1720 aluminum silicate 325 mesh powder glass.

12. The cover of claim 1 wherein the plastic is Lexan thermoplastic.

13. A cover with light-scattering characteristics for use with packages for displaying alpha-numeric characters, the cover comprising a layer of plastic having a multiplicity of small, solid light-conductive particles randomly located therein and scattered therethrough, wherein said particles have an index of refraction different from the index of refraction of the plastic layer and wherein said particles comprise ten to eleven percent by weight of the cover.

14. The cover of claim 13 wherein the plastic layer is transparent.

15. The cover of claim 13 wherein the plastic layer is translucent.

16. The cover of claim 13 wherein the small particles comprise glass.

17. The cover of claim 13 wherein the small particles comprise crystal.

18. The cover of claim 13 wherein the small particles comprise plastic.

19. The cover of claim 13 wherein the small particles comprise a transparent material.

20. The cover of claim 13 wherein the small particles comprise a translucent material.

21. A package for selectively displaying one of a plurality of alpha-numeric characters using a plurality of light-emitting diodes, each diode having a light-emitting surface providing a point of light corresponding to a segment of said characters when electrically activated, comprising:

a plurality of light-emitting diodes in the general shape of the necessary segments of all the alpha-numeric characters to be displayed, arranged laterally on a supporting substrate;

a plurality of light pipes, one above each diode for transmitting light therethrough; and a protective cover overlying said diodes, said supporting substrate, and said light pipes, said cover comprising a plastic layer with a multiplicity of small, solid, light-conductive particles scattered randomly therein, the particles having an index of refraction that is different from that of the plastic layer and comprising from ten to eleven percent by weight of said protective cover.

22. In a package for selectively displaying one of a plurality of alpha-numeric characters having a plurality of light-emitting diodes, each diode having a light-emitting surface providing a point source of light corresponding to a segment of said characters when electrically activated, and a protective cover overlying said diodes and the support for said diodes, the improvement comprising a plurality of small, solid, light-conductive particles scattered randomly within the protective cover, the particles having an index of refraction that is different from that of the protective cover and comprising ten to eleven percent by weight of the cover.

* * * * *